United States Patent [19]

Cairns

[11] Patent Number: 4,802,962

[45] Date of Patent: Feb. 7, 1989

[54] TREATMENT OF CATHODES FOR USE IN ELECTROLYTIC CELL

[75] Inventor: John F. Cairns, Cheshire, England

[73] Assignee: Imperial Chemical Industries PLC, London, England

[21] Appl. No.: 149,927

[22] Filed: Jan. 29, 1988

Related U.S. Application Data

[63] Continuation of Ser. No. 640,936, Aug. 15, 1984, abandoned.

[30] Foreign Application Priority Data

| | | | |
|---|---|---|---|
| Aug. 22, 1983 | [GB] | United Kingdom | 8322563 |
| Jan. 30, 1984 | [GB] | United Kingdom | 8402347 |
| Feb. 7, 1984 | [GB] | United Kingdom | 8403177 |

[51] Int. Cl.[4] ..... C25F 1/00

[52] U.S. Cl. ..... 204/145 R; 204/141.5; 204/144; 204/144.5; 422/12; 422/13; 422/17; 134/22.14; 134/22.19

[58] Field of Search ..... 204/98, 128, 129, 140, 204/141.5, 144, 144.5, 145 R; 422/12, 13, 17; 134/22.14, 22.19

[56] References Cited

U.S. PATENT DOCUMENTS

| | | | |
|---|---|---|---|
| 3,119,760 | 1/1964 | Foreman et al. | 204/269 |
| 3,796,645 | 3/1974 | Fujita et al. | 204/141.5 |
| 4,105,516 | 8/1978 | Martinsons et al. | 204/98 |
| 4,162,949 | 7/1979 | Hine | 204/140 |
| 4,169,775 | 10/1979 | Kuo | 204/128 |
| 4,174,269 | 11/1979 | Carlin et al. | 204/129.95 |
| 4,264,418 | 4/1981 | Wood et al. | 204/141.5 |
| 4,292,159 | 9/1981 | Kuo et al. | 204/128 |
| 4,379,035 | 4/1983 | Chamberlin | 204/128 |
| 4,443,307 | 4/1984 | Moore et al. | 204/128 |
| 4,470,890 | 9/1984 | Bommzrzju et al. | 204/98 |
| 4,482,436 | 11/1984 | Bon | 204/73 R |

FOREIGN PATENT DOCUMENTS

| | | | |
|---|---|---|---|
| 0035837 | 9/1981 | European Pat. Off. | 204/98 |
| 0011790 | 1/1983 | Japan | 204/128 |
| 909596 | 10/1962 | United Kingdom | 422/13 |

OTHER PUBLICATIONS

Encyclopedia of the Electrochemistry of the Elements, vol. IXa, pp. 462–465, 498–501 and 546–548, Editor; A. Bard, Marcel-Dekker.

*Primary Examiner*—John F. Niebling
*Assistant Examiner*—Kathryn Gorgos
*Attorney, Agent, or Firm*—Cushman, Darby & Cushman

[57] ABSTRACT

A method of treating the surface of a cathode in order to remove therefrom deposited iron, the cathode comprising a metallic substrate at least part of the surface of which has been activated in order to reduce the hydrogen overvoltage at the cathode when the cathode is used in the electrolysis of water or aqueous solutions, and the method comprising contacting the surface with a liquid medium which reacts with and solubilizes the deposited iron.

Removal of deposited iron results in a decrease in the hydrogen overvoltage of the cathode. The liquid medium may be an aqueous acidic solution and the cathode may be contacted with the liquid medium in situ in the electrolytic cell.

13 Claims, No Drawings

TREATMENT OF CATHODES FOR USE IN ELECTROLYTIC CELL

This is a continuation of application Ser. No. 640,936, filed Aug. 15, 1984, which was abandoned upon the filing hereof.

This invention relates to the treatment of cathodes for use in electrolytic cells, which cathodes have been activated so that they are capable of operating at low hydrogen overvoltage when used in the electrolysis of water or aqueous solutions.

Electrolytic cells are known comprising an anode, or a plurality of anodes, and a cathode, or a plurality of cathodes, with each anode and adjacent cathode being separated by a substantially hydraulically impermeable cation permselective membrane.

In recent years, such electrolytic cells have been developed, and continue to be developed, for use in the electrolysis of water or aqueous solutions, particularly aqueous solutions of alkali metal chlorides, that is, for use in chlor-alkali electrolysis. When such a solution is electrolysed in an electrolytic cell equipped with a cation permselective membrane the solution is charged to the anode compartments of the cell, and chlorine produced by electrolysis and depleted alkali metal chloride solution are removed from the anode compartments, alkali metal ions are transported across the membranes to the cathode compartments of the cell to which water or dilute alkali metal hydroxide solution is charged, and hydrogen and alkali metal hydroxide solution produced by the reaction of alkali metal ions with water are removed from the cathode compartments of the cell.

In operating such chlor-alkali cells, it is clearly desirable that the voltage of operation at a given current density should be as low as possible in order that the power costs incurred in the electrolysis may be as low as possible. The voltage at which a solution is electrolysed is made up of a number of elements, namely the theoretical electrolysis voltage, the overvoltges at the anode and cathode, the resistance of the solution which is electrolysed, the resistance of the membrane positioned between the anode and the cathode, and the resistance of the metallic conductors and their contact resistances.

In recent years, considerable attention has been devoted to attempts to activate the surfaces of cathodes for use in the electrolysis of water or aqueous solutions in order to reduce the hydrogen overvoltage at the cathodes when used in such electrolysis. Various techniques for so activating cathode surfaces by modifying the surface structure of the cathode and/or by coating the surface of the cathode have been developed. For example, it has been proposed to produce a high surface area cathode by roughening the surface of the cathode, for example, by subjecting the surface to abrasion, e.g. by sand-blasting, or by chemical etching of the surface. It has also been proposed to produce a high surface area cathode by depositing on the cathode a layer of a mixture of two or more metals and subsequently leaching one of the metals out of the surface layer.

Other methods of achieving a low hydrogen overvoltage cathode which have been proposed involve coating of the surface of the cathode with an electrocatalytically-active material.

Methods of coating the surface of a cathode which have been proposed in an attempt to reduce the hydrogen overvoltage at the cathode include the following.

U.S. Pat. No. 4100049 disclosese a cathode comprising a substrate of iron, nickel, cobalt or alloys thereof and a coating of a mixture of a precious metal oxide, particularly palladium oxide, and a valve metal oxide, particularly zirconium oxide.

British Pat. No. 1511719 discloses a cathode comprising a metal substrate, which may be ferrous metal, copper or nickel, a coating of cobalt, and a further coating consisting of ruthenium.

Japanese Patent Publication No. 54090080 discloses pre-treating an iron cathode with perchloric acid followed by sinter coating the cathode with cathode active substances, which may be ruthenium, iridium, iron or nickel in the form of the metal or a compound of the metal.

Japanese Patent Publication No. 54 110983 discloses a cathode, which may be of mild steel, nickel or nickel alloy and a coating of a dispersion of nickel or nickel alloy particles and a cathode activator which comprises one or more of platinum, ruthenium, iridium, rhodium, palladium or osmium metal or oxide.

Japanese Patent Publication No. 53010036 disclose a cathode having a base of a valve metal and a coating of an alloy of at least one platinum group metal and a valve metal, and optionally a top coating of at least one platinum group metal.

Japanese Patent Publication No. 5713189 discloses a cathode of nickel or nickel alloy substrate to the surface of which a coating of platinum group metal or oxide thereof is applied.

Published British Patent Application No. 2074190 discloses a cathode of nickel or nickel alloy having a coating thereon of a platinum group metal or a mixture thereof which has been applied by a displacement deposition process.

Although it is possible to activate the surface of a cathode so that in use in the electrolysis of water or aqueous solutions, e.g. in the electrolysis of aqueous alkali metal chloride solution, the hydrogen overvoltage at the surface of the cathode is reduced this reduction in overvoltage may be short-lived. In use the hydrogen overvoltage at the cathode generally increases and eventually it may reach a value which approaches or is the same as the overvoltage at the unactivated cathode.

I believe that this progressive increase in hydrogen overvoltge at a cathode which has previously been activated in order to reduce the hydrogen overvoltage is caused at least in part by deposition of iron onto the activated surface of the cathode. Iron may be present in solution or in dispersion in the liquors in the cathode compartments of the cell, the iron being derived for example from the various parts of the plant which are made of steel or other ferrous alloys.

The present invention relates to treating an activated cathode, the surface of which has been deactivated by deposition of iron thereon, in order to reactivate the surface of the cathode by selectively removing deposited iron from the surface thereof.

According to the present invention, there is provided a method of treating the surface of a cathode in order to remove therefrom deposited iron; the cathode comprising a metallic substrate at least part of the surface of which has been activated in order to reduce the hydrogen overvoltage at the cathode when the cathode is used in the electrolysis of water or aqueous solutions, and the method comprising contacting the surface with a liquid medium which reacts with and solubilises the deposited iron.

The liquid medium with which the surface of the cathode is contacted reacts with and solubilizes the iron deposited on the cathode with the result that the cathode, when re-used in the electrolysis of water or an aqueous solution, again operates at a low hydrogen overvoltage which may approach or be the same as the hydrogen overvoltage before deposition of iron on the surface of the cathode.

The cathode comprises a metallic substrate. The metallic substrate may be, for example, iron. However, it is very much preferred that the metallic substrate of the cathode is non-ferrous. Thus, for example, the metallic substrate may comprise a valve metal, e.g. titanium, or it may comprise copper or molybdenum, or alloys of these metals. However, it preferably comprises a nickel or nickel alloy as such a metal or alloy is particularly suitable for use as a cathode in a chlor-alkali cell on account of its corrosion resistance. The cathode may be made of nickel or nickel alloy or it may comprise a core of another metal, e.g. iron or steel, or copper, and an outer surface of nickel or nickel alloy.

In the method of the invention the liquid medium should preferentially react with and solubilizes the deposited iron rather than the metal of the substrate or the coating if any, on the surface of the substrate. For example, in the case where the metallic substrate comprises the preferred nickel or nickel alloy, the liquid medium must preferentially react with and solubilize deposited iron rather than nickel or nickel alloy of the substrate. If the liquid medium were to be one which preferentially reacted with and solubilized the metal of the substrate rather than the deposited iron the metallic substrate would be attacked preferentially, and there may be irreversible damage to the activated surface of the cathode. In an extreme case, and where the activated surface comprises a coating, the coating may be caused to fall from the surface of the cathode.

In order to avoid damage to the activated surface of the metallic cathode, it is preferred that the rate at which the liquid medium reacts with and solubilizes deposited the iron is greater than and is preferably at least three times, more preferably at least ten times, greater than the rate at which the liquid medium reacts with and solubilises the metal of the substrate.

The selection of suitable liquid media which satisfy the aforementioned reaction and solubilization criteria may be assisted by reference to suitable reference works in the field of corrosion, and by means of a simple test. For example, where the cathode comprises the preferred nickel or nickel alloy substrate, samples of iron and nickel may be separately immersed in the selected liquid medium and the loss of weight of the samples determined as a function of time.

In general, the liquid medium will be an aqueous solution, but is not necessarily an aqueous solution.

The liquid mediuim may be an aqueous solution of an acid, which may be a strong acid. For example, an aqueous hydrochloric acid solution at a concentration of up to 50% by volume, or an aqueous sulphuric acid solution at a concentration of up to 10% by volume, may be used to remove deposited iron selectively from the surfajce of the cathode comprising a surface roughened nickel or nickel alloy substrate without significant damage to the activated surface being effected, provided that the time of contact is not too great.

The liquid medium may be an aqueous solution of a weak acid. For example, the liquid medium may be an aqueous solution of an organic acid, e.g. citric acid, acetic acid, glycollic acid, lactic acid, tartaric acid; an amino-carboxylic acid; or benzoic acid.

The liquid medium may be an aqueous solution of an alkali. For example, it may be an aqueous solution of an alkali metal hydroxide, which solution should be substantially free of iron. The rate of dissolution of the deposited iron in such a solution may be slow. The rate may be increased by anodically polarizing the cathode.

The method of the inventon may be effected by removing the cathode from the electrolytic cell in which it has been used and thereafter effecting contact between the cathode and the liquid medium. For example the cathode may be immersed in the liquid medium.

In general a liquid medium at elevated temperature will be used as the use of elevated temperature assists in reaction of the liquid medium and resultant solubilisation of deposited iron. A temperature in the range 50° C. to 100° C. will generally be used.

The time for which the contact is effected will depend on a number of factors, for example, the nature of the liquid medium, the temperature of the liquid medium, the amount of iron deposited on the cathode and the crystalline form thereof, and the extent to which it is desired to remove the iron deposited on the cathode. In general, the higher the temperature of the liquid medium the shorter will be the contact time required. The greater the extent of deposition of the iron the longer will be the time for which contact must be effected.

In order to increase the rate of dissolution of deposited iron the cathode may be anodically polarized.

Activation of the surface of the metallic substrate of the cathode, particularly where the metallic substrate is of nickel or nickel alloy, may result in production of a cathode which in the electrolysis of an aqueous alkali metal chloride solution operates initially at a hydrogen overvoltage below 100 m volts, and possibly as low as 50 m volts. During use of the cathode, the hydrogen overvoltage will increase and eventually it may increase to a value approaching that of an unactivated nickel or nickel alloy cathode, e.g. about 350–400 m volts, depending on the current density.

As the power costs of electrolysis increase in direct proportion to the increase in electrolytic cell voltage at constant current density, it may be economically advantageous to treat the cathode in the method of the invention before the hydrogen overvoltage has reached that of an unactivated cathode, e.g. in the case of a nickel or nickel alloy cathode, when the hydrogen overvoltage has reached about 200 m volts. On the other hand as there is a cost associated with operation of the method of the invention, and as a long contact time between the liquid medium and the cathode may be required to achieve a hydrogen overvoltage performance the same as that at which the cathode initially performed, it may be economically advantageous to effect the method of the invention for a length of time less than that required to regain the initial hydrogen overvoltage performance.

After treatment in the method of the invention, the cathode may be re-installed in the electrolytic cell and electrolysis may be re-commenced.

The method of the invention may be applied to any cathode at least a part of the surface of which has been activated in order to reduce the hydrogen overvoltage of the cathode when used in the electrolysis of water or an aqueous solution and which has been deactivated by deposition of iron.

The method of the present invention may be applied to a cathode, the surface of which has been activated by any of the methods hereinbefore described. However, it is particularly suitable for use with a cathode which has been activated by application of a coating of, or at least an outer coating of, at least one platinum group metal and/or at least one platinum group metal oxide to the surface of the cathode. For example, the method of the invention is particularly suitable for use with a cathode comprising a coating of a platinum group metal or a mixture thereof, or a coating of a platinum group metal oxide or a mixture thereof, or a coating of a platinum group metal and a platinum group metal oxide, on a nickel or nickel alloy substrate.

Such coatings, and methods of application thereof are described in the prior art.

In an alternative embodiment the method of the invention may be effected by contacting the cathode with the liquid medium in situ in the electrolytic cell, for example, by removing the catholyte from the cathode compartment of the cell and charging the liquid medium to the cathode compartment. This embodiment is much preferred as it avoids the necessity of removing the cathode from the electrolytic cell prior to operation of the method of the invention. However, care must be taken to use a liquid medium which does not have an adverse effect on the cation-exchange membrane in the electrolytic cell, for example, which subsequently causes the membrane to operate at a reduced current efficiency. A suitable liquid medium is a concentrated aqueous solution of alkali metal hydroxide substantially free of iron, for example an aqueous solution of sodium hydroxide, in which the deposited iron, which generally has a high surface area, dissolves at a faster rate than does metal of the substrate, particularly in the case where the latter is nickel or a nickel alloy.

This embodiment of the method of the invention may be effected by periodically charging to the cathode compartment of the electrolytic cell an aqueous alkali metal hydroxide solution which is substantially free of iron for a time sufficient to result in the desired reduction in the hydrogen overvoltage of the cathode. If desired, the electrolysis may be continued in the presence of aqueous alkali metal hydroxide solution substantially free of iron in the cathode compartment.

Where the cathode is contacted with the liquid medium in situ in the electrolytic cell, e.g. by charging the liquid medium to the cathode compartment of the cell, dissolution of deposited iron may be accelerated by forming a direct electrical connection between the anode and cathode external of the electrolytic cell. In this case, the cathode of the electrolytic cell acts as an anode and the anode as a cathode until the cell has been discharged.

Such a direct electrical connection is readily effected by shorting out of an electrolytic cell, for example by shorting out one cell of a series of electrolytic cells, and in this case, the liquid medium is conveniently the aqueous alkali metal hydroxide solution which is already in the cathode compartment of the cell.

Dissolution of deposited iron may be further assisted by connecting the electrolytic cell to a source of power and anodically polarizing the cathode.

Where the method of the invention is effected by contacting the cathode with the liquid medium in situ in the electrolytic cell it is much preferred that the liquid medium is one which does not result in excessive swelling of the membrane in the electrolytic cell as such excessive swelling may result in a substantial reduction in current efficiency when electrolysis is re-commenced. The excessive swelling referred to is that additional to the swelling of the membrane which has been effected by contact of the membrane with the liquors in the anode and cathode compartments of the electrolytic cell during electrolysis. Thus, it is preferred that where the cathode is contacted with the liquid medium in situ in the electrolytic cell that the membrane is not swollen to an extent greater than the amount by which the membrane is swollen by contact with the liquors in the anode and cathode compartments of the electrolytic cell during electrolysis. In this respect, some of the aqueous acidic solutions hereinbefore described may be unsuitable for use in situ, in the electrolytic cell, although they are quite suitable for treatment of the cathode when the cathode is removed from the electrolytic cell prior to contact with the acid solution. Whether or not a liquid medium is one which will result in excessive swelling may be determined by a simple test by contacting a membrane with the cell liquors and the liquid medium and observing the extent of swelling.

Swelling of the membrane by contact of the cathode with a liquid medium in situ in the electrolytic cell may be controlled by (a) controlling the activity of the water in the liquid medium, that is by reducing the activity coefficient of the water, in the case where an aqueous solution is used, (b) controlling the time of contact of the membrane with the liquid medium, and/or (c) controlling the temperature of the liquid medium.

In general, the swelling of the membrane which is effected by contact of the membrane with a liquid medium will be greater the greater is the temperature of the liquid medium and the longer is the time for which the membrane and the liquid medium are in contact.

Thus, it is preferred to use as low a temperture and as short a contact time as possible consistent with achieving the desired dissolution of iron from the cathode and the desired improvement in the hydrogen over-voltage performance of the cathode.

Where the liquid medium comprises, for example, a dilute aqueous solution of an acid, the activity of the water in the solution is high with the result that undesirable and excessive swelling of the membrane may be effected when the liquid medium is contacted with the membrane. The activity of the water in such an aqueous solution, and thus the extent of swelling of the membrane brought about by contact of the membrane with the liquid medium, may be reduced by including in the aqueous solution one or more soluble organic compounds of relatively high molecular weight which do not themselves cause membrane swelling. Suitable such organic compounds include, for example, sucrose, glucose and fructose and other relatively high molecular weight organic compounds, e.g. glycerol. Other suitable water-soluble organic compounds include water-soluble organic polymeric materials, for example, polyolefin oxides, e.g. polyethylene oxide.

Alternatively, or in addition, the activity of the water in an aqueous solution of an acid may be reduced by increasing the concentration of the acid in the solution.

Thus, a suitable liquid medium for effecting the method of the present invention may be a concentrated aqueous solution of an acid, particularly a concentrated aqueous solution of an organic acid. The acid may be in the form of a salt of the acid, and a preferred example is ammonium citrate.

Whether or not a particular liquid medium is suitable for use in the method of the invention when the liquid mediium is contacted with the cathode in situ in the electrolytic cell is dependent inter alia on the nature of the membrane which is used in the electrolytic cell.

Selection of suitable liquid medium which do not result in excessive swelling of the membrane may be made by a simple test in which the liquid medium is contacted with the cathode in situ in the electrolytic cell, and the effect on the membrane, and in particular on the current efficiency of electrolysis, is determined by subsequently effecting electrolysis and determining the current efficiency of the electrolysis and comparing the latter with the current efficiency of the electrolysis before application of the method of the invention.

Where the liquid medium is contacted with the cathode in situ in the electrolytic cell, it is desirable that the electrolyte be retained in the anode compartment of the electrolytic cell in order to prevent contact of the liquid medium with the anode of the electrolytic cell, and particularly with the coating on the anode. The electrolyte may suitably be circulated through the anode compartment of the electrolytic cell.

The anode in the electrolytic cell may be metallic, and the nature of the metal will depend on the nature of the electrolyte to be electrolysed in the electrolytic cell. A preferred metal is a film-forming metal, particularly where an aqueous solution of an alkali metal chloride is to be electrolysed in the cell.

The film-forming metal may be one of the metals titanium, zirconium, niobium, tantalum or tungsten or an alloy consisting principally of one or more of these metals and having anodic polarization properties which are comparable with those of the pure metal. It is preferred to use titanium alone, or an alloy based on titanium and having polarization properties comparable with those of titanium.

The anode may have a coating of an electroconducting electro-catalytically active material.

Particularly in the case where an aqueous solution of an alkali metal chloride is to be electrolyzed this coating may for example consist of one or more platinum group metals, that is platinum, rhodium, iridium, ruthenium, osmium and palladium, or alloys of the said metals, and/or an oxide or oxides thereof. The coating may consist of one or more of the platinum group metals and/or oxides thereof in admixture with one or more nonnoble metal oxides, particularly a film-forming metal oxide. Especially suitable electro-catalytically active coatings include platinum itself and those based on ruthenium dioxide/titanium dioxide, ruthenium dioxide/tin dioxide, and ruthenium dioxide/tin dioxide/-titanium dioxide.

Such coatings, and methods of application thereof, are well known in the art.

Cation permselective membranes are known in the art. The membrane is preferably a fluorine-containing polymeric material containing anionic groups. The polymeric material is preferably a fluoro-carbon containing the repeating groups $$[C_mF_{2m}]_M \quad \text{and} \quad [CF_2-\underset{X}{CF}]_N$$

where m has a value of 2 to 10, and is preferably 2, the ratio of M to N is preferably such as to give an equivalent weight of the groups X in the range 500 to 2000, and X is chosen from $$[OCF_2-\underset{Z}{\overset{A}{CF}}]_P A \quad \text{or}$$

where P has the value of for example 1 to 3, Z is fluorine or a perfluoroalkyl group hving from 1 to 10 carbon atoms, and A is a group chosen from the groups:

$-SO_3H$
$-CF_2SO_3H$
$-CF_2SO_3H$
$-CCl_2SO_3H$
$-X^1SO_3H$
$-PO_3H_2$
$-PO_2H_2$
$-COOH$ and
$-X^1OH$ or derivatives of the said groups, where $X^1$ is an aryl group. Preferably A represents the group $SO_3H$ or —COOH. $SO_3H$ group-containing ion exchange membranes are sold under the tradename 'Nafion' by E I DuPont de Nemours and Co Inc and —COOH group-containing ion exchange membranes under the tradename 'Flemion' by the Asahi Glass Co Ltd.

The invention is illustrated by the following Examples.

EXAMPLE 1

A flat nickel disc of 1mm thickness (BS NA11, Vickers Hardness 100) was coated with a coating of a mixture of ruthenium and platinum by the chemical displacement process described in published British Patent Application No. 2 074 190. The nickel disc was shot-blasted, degreased by immersion in acetone and then allowed to dry. The nickel disc was then etched by immersion in 2N nitric acid for 1 minute, rinsed in distilled water and immersed for 15 minutes in a mixture of an aqueous solution of cloroplatinic acid (25 ml containing 4 g/l Pt) and an aqueous solution of ruthenium trichloride (25 ml containing 4 g/l Ru). The pH of the solution was 1.62. The coating on the surface of the nickel disc contained 25% by weight of ruthenium and 75% by weight of platinum.

The thus coated nickel disc was installed as a cathode in an electrolytic cell equipped with a titanium grid anode having a coating of 35% by weight $RuO_2$ and 65% by weight $TiO_2$, the anode and cathode being separated by a cation-exchange membrane comprising a perfluoropolymer having carboxylic acid ion-exchange groups and an ion-exchange capacity of 1.5 milliequivalents per gram of dry membrane.

A saturated aqueous solution of sodium chloride was charged continuously to the anode compartment of the electrolytic cell, the cathode compartment was filled with 35% by weight aqueous sodium hydroxide solution, and electrolysis was commenced at a current density of 3 $kA/m^2$ of cathode surface and a temperature of 90° C. Water was charged continuously to the cathode compartment at a rate sufficient to maintain a concentration of approximately 35% by weight of sodium hydroxide in the cathode compartment.

After electrolysis for 1 day at a current density of 3 kA/m$^2$ and a temperature of 90° C., the sodium hydroxide concentration was 33.6% by weight and the hydrogen overvoltage was 59 m volts.

After electrolysis for 6 days at a current density of 3 kA/m$^2$ and a temperature of 90° C., the sodium hydroxide concentration was 37.1% by weight, and the hydrogen overvoltage ws 60 m volts, and the sodium hydroxide current efficiency was 88%.

Thereafter, ferric ammonium sulphate was dissolved in the water which was charged to the cathode compartment of the cell such that the concentration of iron in the liquor in the compartment was 2 parts per million weight/volume.

After a further 28 days of electrolysis, the hydrogen overvoltage was 170 m volts.

Thereafter, the addition of ferric ammonium sulphate was discontinued and replaced by ferrous ammonium sulphate such that the water charged to the cathode compartment of the cell contained 2 parts per million iron weight/volume.

After a further 34 days of electrolysis, the hydrogen overvoltage was 183 m volts, and after a further 9 days of electrolysis, the hydrogen overvoltage was 200 m volts, the sodium hydroxide concentration being 35.2% by weight and the sodium hydroxide current efficiency was 88%.

The supply of current to the cell was then discontinued, and the contents of the cell were allowed to cool to 60° C. The supply of water and of aqueous sodium chloride solution was then stopped, the sodium hydroxide solution was drained from the cathode compartment of the cell, and the compartment was filled with liquid medium comprising a solution made by mixing 400 ml of a 60% by weight aqueous solution of citric acid and 200 ml of concentrated aqueous ammonia (specific gravity 0.88). The temperature of the solution was maintained at 60° C. for 2 hours, the solution was drained from the cathode compartment and replaced by a fresh solution at 60° C., and after 10 minutes the fresh solution was drained from the cathode compartment.

The cathode compartment was then filled with 35% by weight aqueous sodium hydroxide solution and electrolysis was recommenced at a cathode current density of 3kA/m$^2$ and a temperature of 90° C.

After 2 hours electrolysis, the hydrogen overvoltage was 108 m volts, the sodium hydroxide concentration was 35.3% by weight, and the current efficiency was 89%.

After 3 days and 5 days of electrolysis, the sodium hydroxide current efficiency was respectively 86% and 86%, and the hydrogen overvoltage was respectively 87 m volts and 75 m volts.

Example 2

Following the procedure of Example 1, aqueous sodium chloride solution was electrolyzed at a temperature of 90° C. and a current density of 3kA/m$^2$. The 34.8% by weight aqueous solution hydroxide was produced at a current efficiency of 90.8%, and the hydrogen overvoltage at the cathode was 65m volts.

An aqueous solution of ferrous ammonium sulphate was then introduced into the water charged to the cathode compartment of the electrolytic cell at a rate such as to result in a concentration of iron of 5 parts per million weight/volume in the aqueous sodium hydroxide solution in the cathode compartment of the electrolytic cell. When the hydrogen overvoltage at the cathode had increased to 153 m volts, the supply of current to the cell was discontinued, the sodium hydroxide solution was drained from the cathode compartment of the cell, and the cathode compartment was filled with a liquid medium made by dissolving 150 g of citric acid, 120 ml of 0.88 specific gravity ammonium hydroxide solution, and 856 g of sucrose in 600 ml of water. The liquid medium was maintained at 60° C., after 2 hours the liquid medium was removed from the cathode compartment, a fresh sample of liquid medium was charged to the cathode compartment, and after 2 hours this fresh sample was removed from the cathode compartment.

The electrolysis procedure was then recommenced and after 16 hours and 7 days, the sodium hydroxide current efficiency was, respectively, 88.8% and 91%, and the hydrogen overvoltage was, respectively, 111 m volts and 100 m volts.

EXAMPLE 3

The electrolysis procedure of Example 1 was repeated except that the electrolytic cell comprised one anode and two cathodes. The hydrogen overvoltages at the cathodes were respectively 79 m volts and 85 m volts at 3 kA/m$^2$ current density when producing 35% by weight aqueous solution hydroxide solution at 91° C.

Small samples of stainless steel were introduced into the aqueous sodium hydroxide solution in the cathode compartments of the electrolytic cell, and when the hydrogen overvoltages had reached, respectively 219 m volts and 231 m volts, the supply of current to the electrolytic cell was discontinued.

The cathodes were then removed from the cell, washed in distilled water, and immersed in a solution of 5% by weight citric acid in water at a temperature of 53° C. The citric acid solution was allowed to cool to ambient temperature, and after 19 hours, the cathodes were removed from the solution, washed with water, and reinstalled in the electrolytic cell together with a new membrane.

The electrolysis procedure was recommenced to produce 32% by weight aqueous sodium hydroxide solution at 88° C. at a current density of 3 kA/m$^2$. The hydrogen overvoltages at the cathodes were, respectively, 81 m volts and 85 m volts.

I claim:

1. A method of treating the surface of a cathode in order to remove therefrom deposited iron, the cathode comprising a metallic substrate at least part of the surface of which has been activated in order to reduce the hydrogen overvoltage at the cathode when the cathode is used in the electrolysis of water or aqueous solutions, and the method comprising removing the iron deposited upon the activated surface of the cathode by contacting the activated surface with a liquid medium which reacts with and solubilizes the deposited iron, wherein, the cathode is in position in a electrolytic cell and the method is effected by contacting the cathode with the liquid medium in situ in the electrolytic cell, and wherein, the electrolytic cell contains a cation permselective membrane and wherein, the liquid medium is an aqueous solution which contains one or more soluble organic compounds selected from the group consisting of sucrose and an organic polymeric material.

2. A method as in claim 1 wherein, when the membrane is contacted with the liquid medium the membrane is swollen to an extent which is not greater than the extent to which the membrane is swollen by contact with the liquors in the anode and cathode compartments of the cell.

3. A method as claimed in claim 1 in which at least the outer surface of the cathode comprises nickel or a nickel alloy.

4. A method as claimed in claim 3 in which the cathode comprises nickel or a nickel alloy.

5. A method as claimed in claim 1, 2, 3 or 4 in which the liquid medium reacts with and solubilizes deposited iron at a rate which is at least three times greater than the rate at which it reacts with and solubilizes the metal of the substrate.

6. A method as claimed in claim 1 in which the aqueous solution contains an acid.

7. A method as claims in claim 1 in which the aqueous solution contains an organic acid.

8. A method as claimed in claim 7 in which the organic acid is citric acid or a salt thereof.

9. A method as claimed in claim 1 in which the temperature of the liquid medium is in the range 50 C to 100 C.

10. A method as claimed in claim 1 in which the surface of the cathode comprises at least an outer coating of a platinum group metal, or a platinum group metal oxide, or a mixture thereof.

11. A method as claimed in claim 1 in which the cathode is anodically polarized.

12. A method as claimed in claim 1 in which a direct electrical connection is formed between the cathode and the anode of the electrolytic cell external of the electrolytic cell.

13. A method of treating the surface of a cathode in order to remove therefrom deposited iron, the cathode comprising a metallic substrate at least part of the surface of which has been activated in order to reduce the hydrogen overvoltage at the cathode when the cathode is used in the electrolysis of water or aqueous solutions, and the method comprising removing the iron deposited upon the activated surface of the cathode by contacting the activated surface with a liquid medium which reacts with and solubilizes the deposited iron, wherein, the cathode is in position in an electrolytic cell and the method is effected by contactig the cathode with the liquid medium in situ in the electrolytic cell, and wherein, the electrolytic cell contains a cation permselective membrane and in which, when the cathode is contacted with the liquid medium, the membrane is swollen to an extent which is not greater than the extent to which the membrane is swollen by contact with the liquors in the anode and cathode compartments of the cell, and wherein, the liquid medium is an aqueous solution which contains one or more soluble organic compounds selected from the group consisting of sucrose and an organic polymer material.

* * * * *